US009315365B2

(12) United States Patent
Sargent

(10) Patent No.: US 9,315,365 B2
(45) Date of Patent: Apr. 19, 2016

(54) LIFTING ASSEMBLY

(71) Applicant: Robin Sargent, Houma, LA (US)

(72) Inventor: Robin Sargent, Houma, LA (US)

( * ) Notice: Subject to any disclaimer, the term of this patent is extended or adjusted under 35 U.S.C. 154(b) by 147 days.

(21) Appl. No.: 13/909,059

(22) Filed: Jun. 3, 2013

(65) Prior Publication Data

US 2014/0353563 A1 Dec. 4, 2014

(51) Int. Cl.
*B66D 3/18* (2006.01)
*B66D 3/16* (2006.01)

(52) U.S. Cl.
CPC ... *B66D 3/18* (2013.01); *B66D 3/16* (2013.01)

(58) Field of Classification Search
USPC ..... 254/264–266, 333, 334, 338, 342, 358, 254/362, 371, 372, 380, 385
See application file for complete search history.

(56) References Cited

U.S. PATENT DOCUMENTS

| | | | | | |
|---|---|---|---|---|---|
| 596,618 | A | | 1/1898 | Redmon | |
| 756,454 | A | * | 4/1904 | Astrup | 474/144 |
| 768,822 | A | | 8/1904 | Schmick | |
| 1,288,137 | A | * | 12/1918 | Newhall, Jr. | 254/335 |
| 1,468,916 | A | | 9/1923 | Newhall et al. | |
| 2,240,523 | A | | 5/1941 | Schramm | |
| 2,667,331 | A | | 1/1954 | Robins | |
| 3,467,359 | A | | 9/1969 | Durand | |
| 3,611,825 | A | | 10/1971 | Kallaes | |
| 3,628,505 | A | | 12/1971 | Myers | |
| 3,784,165 | A | | 1/1974 | Pruitt | |
| 4,151,981 | A | | 5/1979 | Gennep | |
| 4,196,889 | A | | 4/1980 | Dudek | |
| 4,576,363 | A | * | 3/1986 | Pancook | 254/372 |
| 5,678,452 | A | * | 10/1997 | Frazier | 74/89.21 |
| 6,179,270 | B1 | * | 1/2001 | Higdon | 254/358 |
| 6,218,746 | B1 | | 4/2001 | Gouge, Jr. | |
| 6,386,513 | B1 | * | 5/2002 | Kazerooni | 254/270 |
| 6,554,252 | B2 | * | 4/2003 | Kazerooni et al. | 254/270 |
| 6,554,255 | B2 | * | 4/2003 | Fujikawa | 254/358 |
| 6,820,863 | B2 | * | 11/2004 | Rosati | 254/358 |
| 7,175,162 | B1 | * | 2/2007 | Ratcliff | 254/231 |
| 7,441,749 | B2 | * | 10/2008 | Beaudoin et al. | 254/403 |
| 8,434,742 | B2 | * | 5/2013 | Akhavein et al. | 254/344 |
| 2004/0211951 | A1 | * | 10/2004 | Rosati | 254/358 |

* cited by examiner

*Primary Examiner* — Emmanuel M Marcelo
*Assistant Examiner* — Angela K Caligiuri
(74) *Attorney, Agent, or Firm* — Keaty Law Firm LLC

(57) ABSTRACT

A pull chain moving assembly is designed to impart directional force on an endless-loop pull chain of a chain hoist. The assembly has a housing retaining a chain moving mechanism, which includes a chain pocket wheel and a pair of idler pulley assemblies mounted on opposite sides of the chain pocket wheel and adjacent thereto. Segments of the pull chain are received between the chain pocket wheel and the adjacent idler pulley guide, causing the pull chain to train through the chain moving mechanism. An electric motor rotates the chain pocket guide to facilitate movement of the pull chain and ease of lifting and lowering a load with the chain hoist.

33 Claims, 5 Drawing Sheets

LIFTING ASSEMBLY

BACKGROUND OF THE INVENTION

This invention relates to lifting assemblies, and more particularly to portable raising and lowering devices often referred to as hoists, winches or lifts. More particularly, although not exclusively, the invention relates to such devices intended for increasing lifting and lowering capacity of manual hoists commonly known as chain falls. The invention also relates to equipment used as parts of, or for operation of, such devices.

Typical chain hoists are manually operated. Such devices are used for raising and lowering loads in small warehouses, garages, small shops and other situations, where overhead cranes are not practical or prohibitively expensive. The chain of a manual chain hoist is wrapped around a drum, or load-chain, and is raised by a pulley with a special profile to engage the chain. Chain hoists may have a lever to actuate the hoist or have a loop of operating chain that the user pulls through the block (known traditionally as a chain fall) which then activates the block to take up the main lifting chain.

Raising and lowering of loads using manual chain hoists takes a considerable time. As the user pulls on one side of an endless loop chain the chain is engaged in a compound pulley with two different radii. The teeth of the pulley engage the endless chain, allowing the exerted force to be multiplied. However, even with the chain hoists using the chain fall the job of lifting and lowering a heavy load is arduous and slow.

There exist motorized lifting devices that use electrical, hydraulic or pneumatic power. Such devices can be found in large manufacturing facilities, distribution centers and the like. There is a need to provide an inexpensive lifting device that can retrofit an existing pulley-mounted chain hoist into a motorized lifting device to reduce manual labor involved in lifting and lowering of heavy loads.

SUMMARY OF THE INVENTION

It is, therefore, an object of the present invention to provide a lifting assembly to be used with a chain hoist employing an endless loop chain design.

It is another object of the invention to provide a lifting device that can be easily incorporated with a manual chain hoist.

It is a further object of the invention to provide an easy-to-operate lifting assembly mountable on an endless chain of a chain hoist.

These and other objects of the invention are achieved through a provision of an assembly for moving an endless-loop pull chain of a chain hoist, such as a manual chain hoist having a load hook, a load chain and a pull chain. The assembly comprises a housing having a cup-shaped back cover and a detachable front plate following configuration of the back cover.

A pair of handles is attached to opposite sides of the housing allowing a user to hold the assembly in the user's hands while operating the chain hoist. A chain moving mechanism is mounted in the housing, the chain moving mechanism comprising an electric power source having an output shaft, a first spur gear rotationally connected to the output shaft and a second, larger, spur gear having sprockets meshing with sprockets of the first spur gear.

A chain pocket wheel is operationally connected to the second spur gear; the second spur gear receives rotational force from the first spur gear, which is rotated by the electric motor. A pair of idler pulley assemblies are mounted on opposite sides of and adjacent to, the chain pocket wheel. The chain moving mechanism trains the pull chain of the chain hoist between the chain pocket wheel and each of the idler pulley assemblies. A compression spring is mounted around idler pulley shafts allowing some flexibility of movement of idler pulley guides mounted on the idler pulley shafts.

BRIEF DESCRIPTION OF THE DRAWINGS

Reference will now be made to the drawings, wherein like parts are designated by like numerals, and wherein.

DETAIL DESCRIPTION OF THE INVENTION

Turning now to the drawings in more detail, numeral designates the lifting assembly according to the present invention. The lifting assembly comprises a housing 12, which houses the chain moving mechanism, and a pair of handles 14 and 16 secured to diametrically opposite sides of the housing 12.

Figure 2:
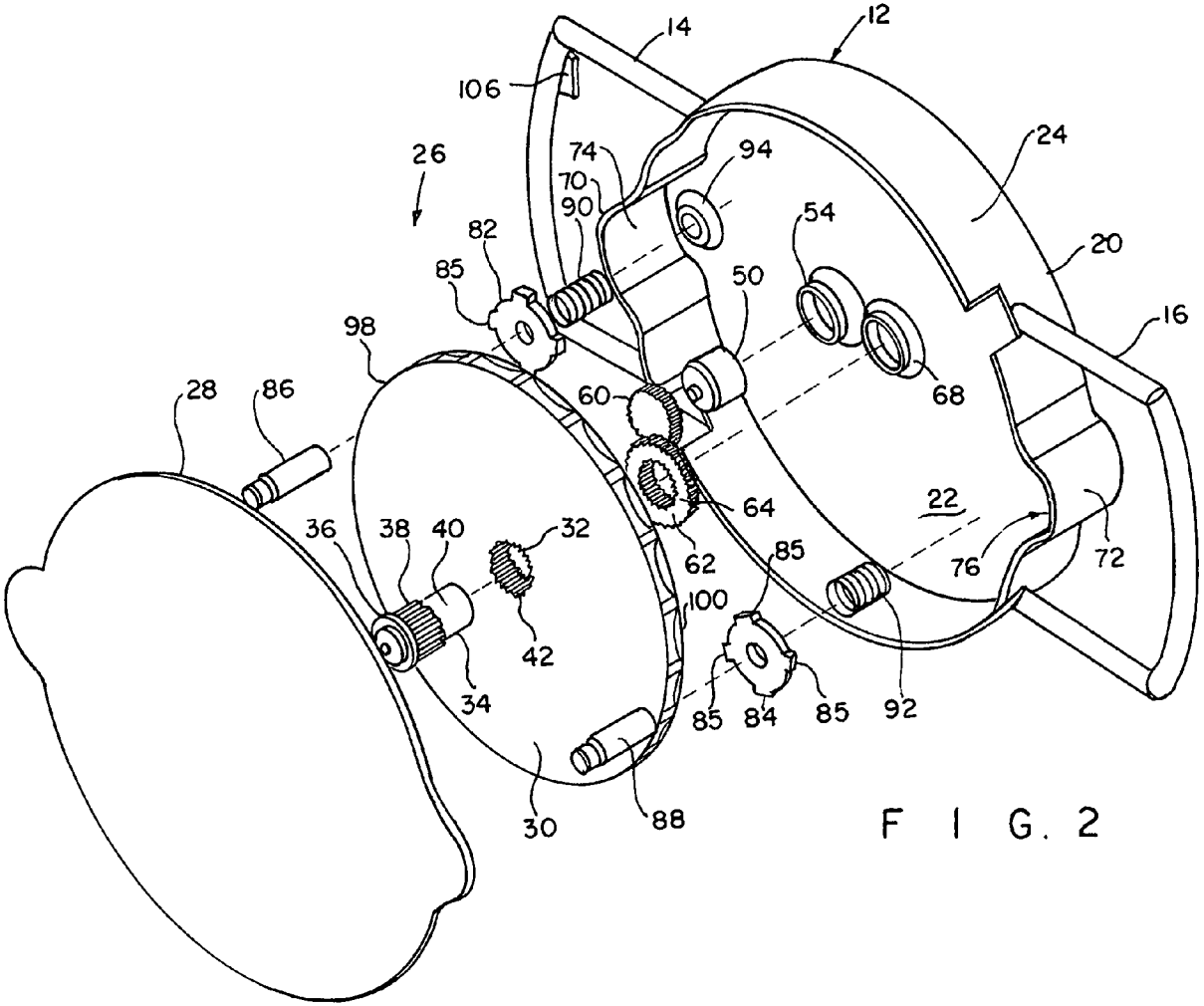
FIG. 2 is an exploded view of a housing enclosing a raising and lowering mechanism.

The housing 12 comprises a back cover 20 formed as a cup defined by a back plate 22 and peripheral wall 24 affixed along the periphery of the back plate 22 and extending transversely thereto. The back cover forms a cavity for receiving a chain moving assembly 26. A front cover 28 is capable of being detachably engaged with the peripheral wall 24 using bolts or other engaging means (not shown). The front cover 28 has a planar configuration substantially following configuration of the back plate 22. As can be seen in FIG. 2, the handles 14 and 16 are secured to the peripheral wall 24. It will be appreciated that the configuration of the housing 12 can be circular, rectangular, oval, etc. depending on the design preferences of the manufacturer.

The chain moving mechanism 26 comprises a main chain pocket wheel 30 formed with a central opening 32 for receiving a cylindrical main shaft 34 therethrough. A front part 36 of the main shaft 34 is formed with a plurality of circumferentially equidistantly disposed shaft teeth 38, while a back part 40 of the main shaft 34 has a smooth exterior. The interior of the central opening 32 is formed with a plurality of grooves 42, which match the spacing of the shaft teeth 38 so that rotational force can be transmitted from the main shaft 34 to the main chain pocket wheel 30, as will be described in more detail hereinafter.

Figure 1:
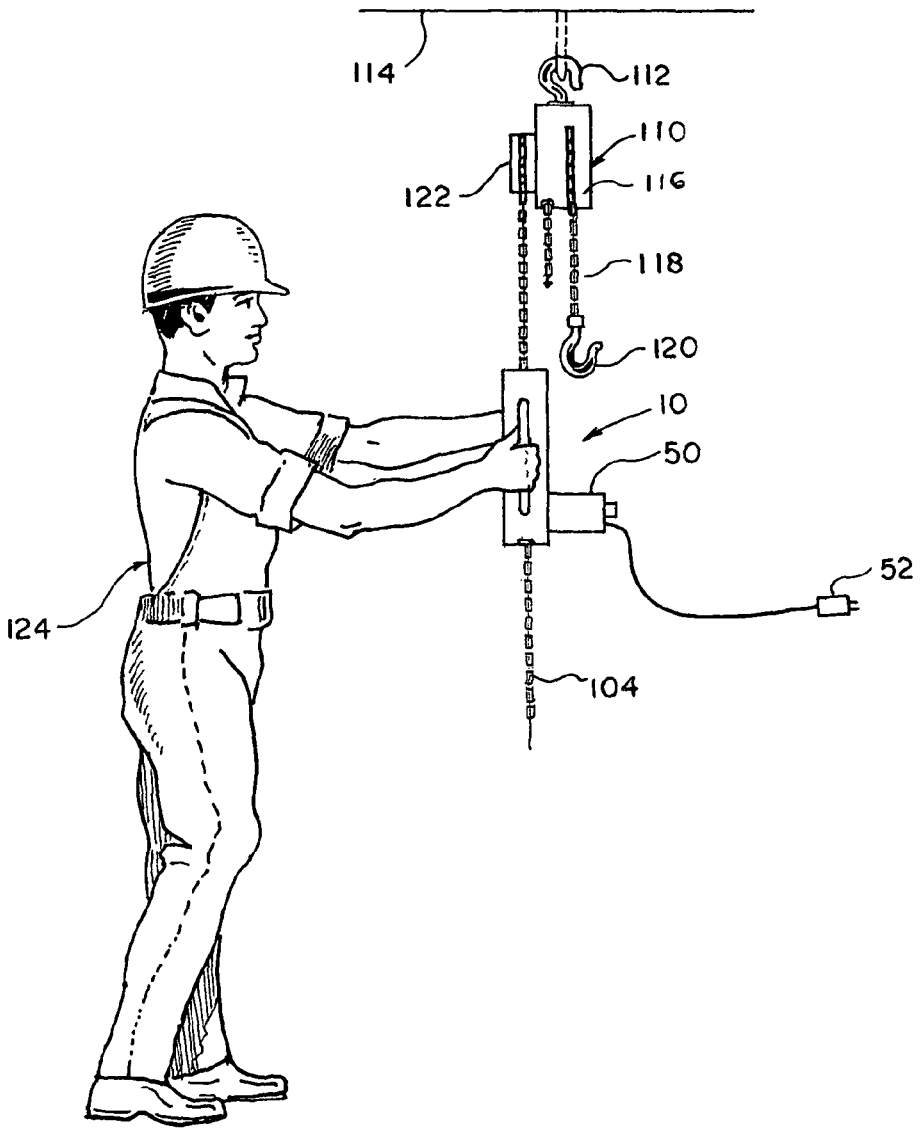
FIG. 1 is side view illustrating the lifting assembly of the present invention incorporated with a chain hoist.

A power source 50 is secured to interior of the back cover 22. The power source can be a bi-directional 120V electric motor connectable to a municipal power source 53. The electric connection is made by suitable wiring 52 extending through an aperture 54 formed in the back plate 22 of the housing 12. A portion of the motor 50 can extend outwardly from the housing 12, as shown in FIG. 1.

A first spur or sprocket gear 60 is operationally connected to an output shaft of the power source 50 and receives rotational force therefrom. The first spur gear 60 is configured as a disk with radially projecting teeth, which are aligned parallel to the axis of rotation of the first spur gear 60. A second spur or sprocket gear 62 is mounted adjacent to the first spur gear 60 such that their centers are parallel to each other. The second spur gear 62 also has radially projecting teeth, which mesh with the teeth of the first spur gear 60 during rotation.

The rotational force is transmitted from the power source 50 to the first spur gear 60, and then to the second spurs gear 62. In an aspect of the invention, the second spur gear has a diameter greater than the diameter of the first spur gear 60 although the linear speed at the pitch diameter is the same on both gears.

The second spur gear 62 has a center opening provided with straight-cut gears or teeth 64, which match the shaft teeth 38 on the main shaft 34. During operation, the second spur gear 62 engages with the main shaft 34 and transmits torque from the motor to the main shaft 34 and thus to the main pocket chain wheel 30. The main shaft 34 is mounted parallel to the output shaft of the power source 50 and co-axially with the center opening of the second spur gear 62. The back part 40 of the main shaft 34 abuts against a shaft receiver member 68 fitted to the interior of the back plate 22.

The back cover 20 is provided with a pair of diametrically opposed outward projections 70, 72. The peripheral wall 24, following the same shape projections on the back plate 22 forms two pockets 74, 76 corresponding to the projections 70, 72, respectively. An idler pulley assembly is fitted into each of the pockets 74, 76 in close proximity to the main pocket chain wheel 30.

Each of the idler pulley assemblies 78, 80 comprises an idler pulley guide 82, 84, respectively, mounted on an idler pulley shaft 86, 88, respectively. A compression spring 90, 92 is fitted around a respective idler pulley shaft 86, 88. The springs 90, 92 are mounted between the idler pulley guides 82, 84 and the interior surface of the back plate 22 allowing the idler pulley guides 82, 84 some degree of longitudinal movement along the idler pulley shafts 86, 88 to accommodate changes in the force vector when the pull chain is moved up or down through the housing 12.

A back end of each idler pulley shaft is fitted into the idler shaft receiver member 94, 96 fitted on the interior of the back plate 22. A front end of each of the idler pulley shafts 86, 88 is in contact with the inner surface of the front plate 28.

Each of the idler pulley guides 82, 84 comprises a planar member having a plurality of outwardly extending projections 85 designed to fit into links of a hoist chain when moving the hoist chain up and down.

Figure 3:
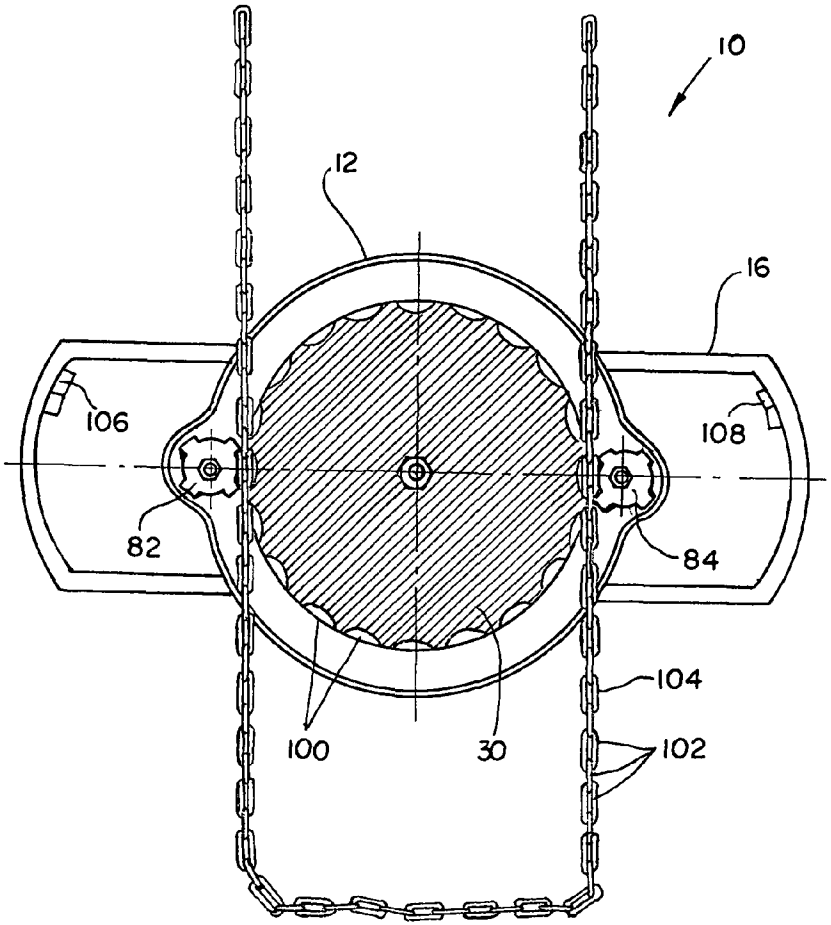
FIG. 3 is a perspective view of the lifting assembly of the present invention with the front cover of the housing removed to show engagement of the chain.
Figure 5:
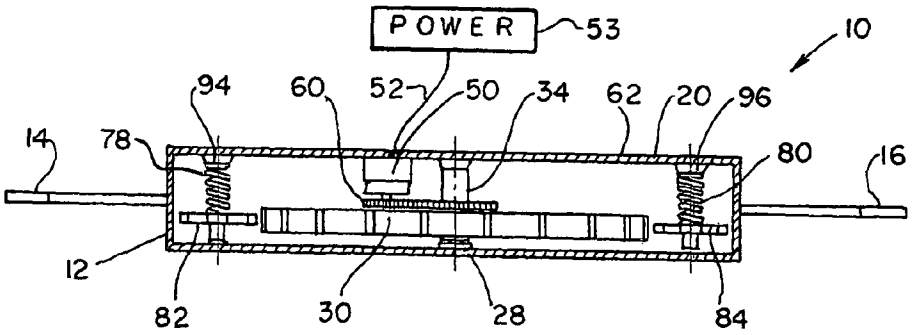
FIG. 5 is section view of the lifting assembly taken along line A-A of FIG. 4.
Figure 4:
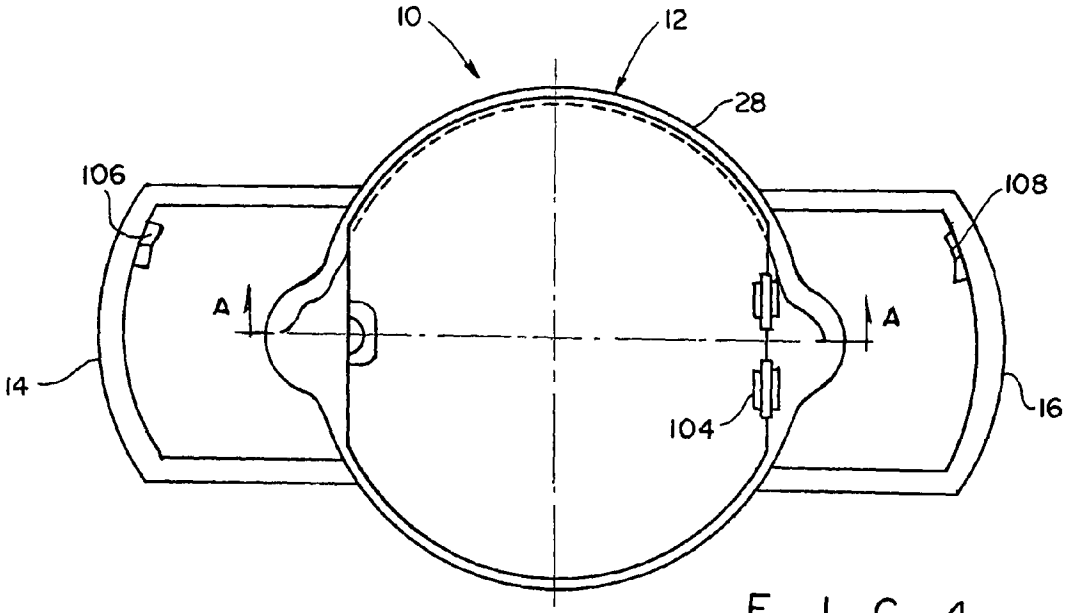
FIG. 4 is a plan front view of the lifting assembly of the present invention.
Figure 7:
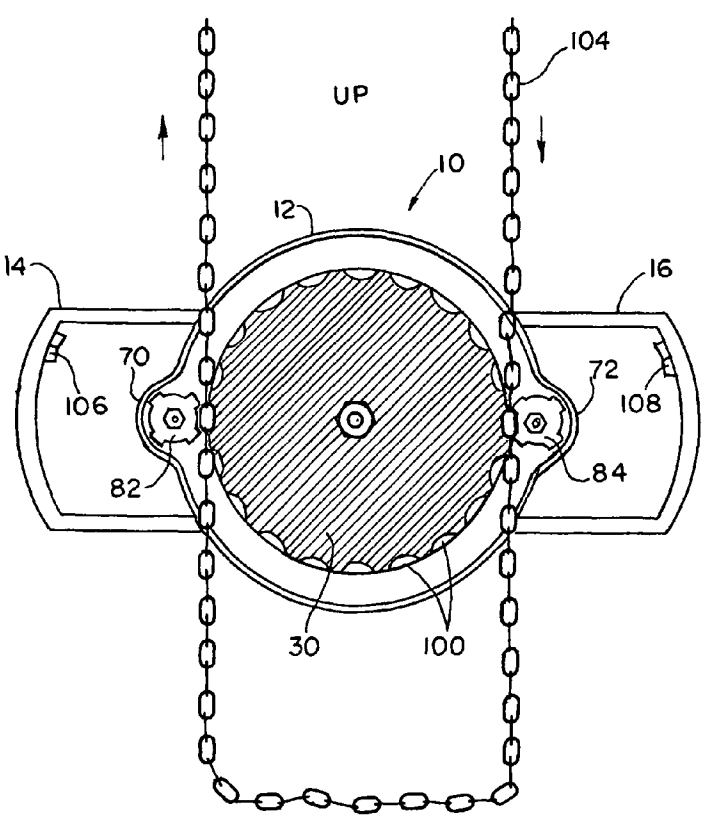
FIG. 7 illustrates the lifting assembly moving the chain of the chain hoist in an upward direction.
Figure 6:
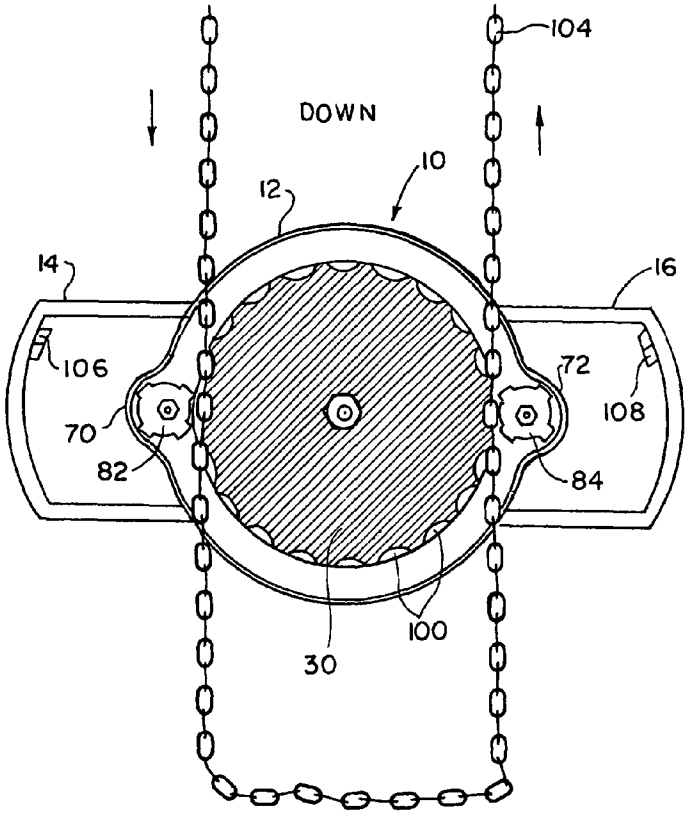
FIG. 6 illustrates the lifting assembly moving the chain of a chain hoist down.

The main pocket chain wheel 30 is configured as a disk having a peripheral edge 98. A plurality of equidistantly spaced pockets or cavities 100 are distributed around the main pocket chain wheel, at positions matching the distribution of links 102 of the pull chain 104 in its extended condition. The concave shape of the pockets 100 allows a link 102 to align itself with the pocket 100 when the chain is moved between the main pocket chain wheel 30 and an idler pulley guides 82, 84, as shown in FIGS. 3, 6, and 7.

Each of the handles 14 and 16 is formed as generally U-shaped member that extends outwardly from the housing 12 in a horizontal orientation. In one aspect of the invention, the handles 14 and 16 are aligned with centers of the respective projections 70, 72 of the housing 12. The handles 14 and 16 can be formed as mirror images of each other. Of course, other ergonomic designs can be used for ease of manipulating the lifting assembly.

A control switch 106 is secured on the handle 14, and a second control switch 108 is secured on the handle 16. The control switches 106, 108 can be toggle switches operationally connected to the power source 50 and capable of activating and de-activating the power source 50. The control switches can also control direction of rotation of the output shaft, and thus direction of rotation of the main chain pocket wheel 30. For instance, the control switch 106 can be used to direct clockwise rotation of the chain pocket wheel 30, while the switch 108 can be used to activate counterclockwise rotation of the output shaft and the wheel. Alternatively, the switch 106 or 108 can be used for switching on the motor 50 and deactivating the motor 50, and the other switch can be used for directing the rotation of the output shaft and the wheel.

FIG. 1 illustrates an exemplary environment where the lifting assembly 10 can be used. In this example, the housing 12 is suspended on the endless loop chain, which is conventionally used in manual pull chain hoists 110. Such manual chain hoist has a mounting hook 112 swivelable engaged between an overhead support 114 such as for instance a sturdy beam. A chain hoist housing 116 is secured to the mounting hook and is suspended therefrom. A loading chain 118 is connected to the chain hoist housing carrying a loading hook 120 on a lower end.

The load "lift" or "pull" wheel 122 about which the pull chain 104 trains is fitted to the chain hoist housing 116. The pull wheel 122 permits the pull chain 104 to travel around the lift wheel 122 in a clockwise and counterclockwise fashion. The pull wheel 122 is mechanically connected to the loading chain 118 to transmit up and down motion to the load hook 120.

In operation, an operator 124 removes the front cover 28 from the housing 12 and positions the housing on the pull chain 104. Spaced apart segments of the pull chain 104 are engaged between respective idler pulley guides 82, 84 and pockets 100 of the sprocket wheel 30. The front cover 28 is then re-engaged with the housing 12.

The operator 124 then grabs the handles 14 and 16 using both hands. By pressing and releasing the control switches 106, 108, the operator causes the sprocket wheel to be rotated clockwise and counterclockwise. The clockwise rotation of the chain pocket or sprocket wheel 30 (FIG. 7) causes the load chain 118 to move up and lift a load suspended from the load hook 120. Counterclockwise rotation of the sprocket wheel 30 (FIG. 6) causes the load chain to move down and lower any load carried by the load hook 120.

Thus, it will be appreciated that the mechanism of the invention is of unique design and construction, whereby a manual chain hoist can be easily modified to include electrically assisted lifting and lowering power. The lifting assembly 10 can be easily disengaged from the pull chain 104 and transported to another location where such devices are required.

Many changes and modifications can be made in the design of the present invention without departing from the spirit thereof. I, therefore pray that my rights to the present invention be limited only by the scope of the appended claims.

I claim:

1. An assembly for moving an endless-loop pull chain of a chain hoist, comprising:

a housing having a back cover and a detachable front plate;

a chain moving mechanism mounted in the housing, the chain moving mechanism comprising a power source having an output shaft, a first sprocket gear having an exterior with radially outwardly projecting gear teeth which are aligned parallel to an axis of rotation of the first spur gear, the first sprocket gear being connected to the output shaft and receiving rotational force from the output shaft, a second sprocket gear having outwardly radially projecting teeth meshing with sprockets of the first sprocket gear, a chain pocket wheel having a central opening provided with a plurality of grooves, the chain pocket wheel being operationally connected to the second sprocket gear and receiving rotational force from the second sprocket gear, and a pair of idler pulley assemblies mounted on opposite sides of the chain pocket wheel, each of the idler pulley assemblies having an idler pulley shaft and a compression spring mounted on the idler pulley shaft, said chain moving mechanism training the pull chain between the chain pocket wheel and each of the idler pulley assemblies.

2. The assembly of claim 1, comprising a main wheel shaft extending in parallel to the output shaft of the power source, the main wheel shaft having a front part provided with a plurality of circumferentially equidistantly longitudinally disposed shaft teeth and a back part with a smooth exterior, said chain pocket wheel is mounted on the wheel main shaft with the shaft teeth engaged in the grooves of the central opening.

3. The assembly of claim 2, wherein the second sprocket gear has a center opening, and wherein the wheel main shaft extends through said center opening.

4. The assembly of claim 3, wherein the center opening of the second sprocket gear is provided with teeth and said wheel main shaft being provided with matching teeth such that torque imparted on the second sprocket gear is transferred to the chain pocket wheel and to the pull chain.

5. The assembly of claim 1, said back cover having a cup-shaped configuration and is defined by a back plate and transversely extending peripheral wall.

6. The assembly of claim 5, comprising a pair of outwardly extending handles, each handle extending on opposite sides of the peripheral wall.

7. The assembly of claim 6, each of said handles carrying a control switch electrically connected to the power source and capable of activating and deactivating the power source and controlling direction of rotation of the output shaft.

8. The assembly of claim 6, each of said handle having a U-shape configuration.

9. The assembly of claim 5, each of the idler pulley assemblies comprising an idler pulley guide mounted adjacent the chain pocket wheel, the idler pulley shaft extending through a center opening of the idler pulley guide.

10. The assembly of claim 9, wherein the compression spring is mounted between the idler pulley guide and the back plate.

11. The assembly of claim 10, said back plate carrying a receiver member for each of the idler pulley shafts.

12. The assembly of claim 1, said chain pocket wheel having a peripheral edge, and wherein a plurality of concave pockets is formed in said peripheral edge.

13. The assembly of claim 12, said pockets being equidistantly spaced about the peripheral edge, each pocket being capable of receiving and engaging a link of the pull chain during movement of the pull chain.

14. The assembly of claim 1, said housing being provided with an outwardly extending projection on each side of the housing, and wherein the idler pulley assembly is mounted in said projection.

15. The assembly of claim 1, wherein diameter of the second sprocket gear is at least slightly greater than diameter of the first sprocket gear.

16. The assembly of claim 1, wherein each of the first sprocket gear and the second sprocket gear comprises a spur gear.

17. The assembly of claim 1, wherein the power source is an electric motor.

18. An assembly for moving an endless-loop pull chain of a chain hoist, comprising:

a housing having a cup-shaped back cover and a detachable front plate;

a pair of handles attached to opposite sides of the housing;

a chain moving mechanism mounted in the housing, the chain moving mechanism comprising an electric power source having an output shaft, a first spur gear having an exterior with radially outwardly projecting gear teeth which are aligned parallel to an axis of rotation of the first spur gear, the first sprocket gear being rotationally connected to the output shaft, a second spur gear having outwardly radially projecting teeth meshing with sprockets of the first spur gear, a chain pocket wheel having a central opening provided with a plurality of grooves, the chain pocket wheel being operationally connected to the second spur gear and receiving rotational force from the second spur gear, and a pair of idler pulley assemblies mounted on opposite sides of and adjacent to, the chain pocket wheel, each of the idler pulley assemblies having an idler pulley shaft and a compression spring mounted on the idler pulley shaft, said chain moving mechanism training the pull chain between the chain pocket wheel and each of the idler pulley assemblies.

19. The assembly of claim 18, each of the idler pulley assemblies comprising an idler pulley guide, the idler pulley shaft extending through a center opening of the idler pulley guide.

20. The assembly of claim 19, wherein the compression spring is mounted between the idler pulley guide and the back cover.

21. The assembly of claim 20, said back cover carrying a receiver member for each of the idler pulley shafts.

22. The assembly of claim 18, wherein diameter of the second spur gear is at least slightly greater than diameter of the first spur gear.

23. The assembly of claim 18, wherein said back cover has a cup-shaped configuration and is defined by a back plate and transversely extending peripheral wall, and wherein each of the handles is secured to the peripheral wall.

24. The assembly of claim 18, comprising a main wheel shaft extending in parallel to the output shaft of the power source, the main wheel shaft having a front part provided with a plurality of circumferentially equidistantly longitudinally disposed shaft teeth and a back part with a smooth exterior, said chain pocket wheel is mounted on the wheel main shaft with the shaft teeth engaged in the grooves of the central opening the main wheel shaft extending co-axially with a center opening of the second spur gear.

25. The assembly of claim 24, wherein the wheel main shaft extends through said center opening of the second spur gear.

26. The assembly of claim 25, wherein the center opening of the second spur gear is provided with teeth and said wheel main shaft is provided with matching teeth such that torque imparted on the second spur gear is transferred to the chain pocket wheel and to the pull chain.

27. The assembly of claim 18, each of said handles carrying a control switch electrically connected to the power source and capable of activating and deactivating the power source and controlling direction of rotation of the output shaft.

28. The assembly of claim 27, wherein said control switch is a toggle switch.

29. The assembly of claim 27, each of said handle having a U-shape configuration.

30. The assembly of claim 18, said chain pocket wheel having a peripheral edge, and wherein a plurality of concave pockets is formed in said peripheral edge.

31. The assembly of claim 30, said pockets being equidistantly spaced about the peripheral edge, and wherein each of said pockets is capable of receiving and engaging a link of the pull chain during movement of the pull chain.

32. The assembly of claim 18, said housing being provided with an outwardly extending projection on each side of the housing, and wherein the idler pulley assembly is mounted in said projection.

33. The assembly of claim 18, wherein the power source is an electric motor.

* * * * *